US007306178B2

(12) United States Patent
Schmitz

(10) Patent No.: US 7,306,178 B2
(45) Date of Patent: Dec. 11, 2007

(54) GRINDING CHAMBER SIDE LINER FOR A COAL PULVERIZER

(75) Inventor: William Schmitz, Clymer, NY (US)

(73) Assignee: Riley Power, Inc., Worcester, MA (US)

( * ) Notice: Subject to any disclaimer, the term of this patent is extended or adjusted under 35 U.S.C. 154(b) by 0 days.

(21) Appl. No.: 11/070,525

(22) Filed: Mar. 2, 2005

(65) Prior Publication Data

US 2006/0196983 A1 Sep. 7, 2006

(51) Int. Cl.
*B02C 17/14* (2006.01)

(52) U.S. Cl. ..... 241/182; 241/299; 241/DIG. 30

(58) Field of Classification Search ..... 241/182, 241/183, 299, DIG. 30
See application file for complete search history.

(56) References Cited

U.S. PATENT DOCUMENTS

| | | | | |
|---|---|---|---|---|
| 1,628,609 | A | 5/1927 | Newhouse | |
| 2,456,266 | A * | 12/1948 | Wearing | 241/91 |
| 2,625,332 | A | 1/1953 | Rogers et al. | |
| 2,628,038 | A | 2/1953 | Rogers et al. | |
| 2,639,863 | A | 5/1953 | Rogers | |
| 3,050,018 | A | 8/1962 | Pearson | |
| 3,092,337 | A | 6/1963 | Patterson | |
| 4,424,938 | A * | 1/1984 | Day | 241/182 |
| 4,485,975 | A * | 12/1984 | Eigner | 241/182 |
| 4,919,795 | A | 4/1990 | Fujii et al. | |
| 5,025,930 | A | 6/1991 | Barthelmess | |
| 5,289,978 | A | 3/1994 | Lundquist | |
| 5,348,272 | A | 9/1994 | Lukstas et al. | |
| 5,560,550 | A | 10/1996 | Krawczyk | |
| 5,938,045 | A | 8/1999 | Makino et al. | |
| 6,027,057 | A * | 2/2000 | Miles | 241/182 |
| 6,443,376 | B1 | 9/2002 | Huang et al. | |
| 6,644,479 | B1 | 11/2003 | Kimmeyer et al. | |
| 2003/0141396 | A1 * | 7/2003 | Whaley | 241/299 |

* cited by examiner

*Primary Examiner*—Faye Francis
(74) *Attorney, Agent, or Firm*—Edwards Angell Palmer & Dodge LLP

(57) ABSTRACT

The present invention is directed to, among other things, a grinding chamber side liner for attaching to the interior of a coal pulverizer housing that includes an overhanging rim for covering gaps between parts installed adjacently with respect to each other within the housing.

19 Claims, 10 Drawing Sheets

GRINDING CHAMBER SIDE LINER FOR A COAL PULVERIZER

BACKGROUND OF THE INVENTION

1. Field of the Invention

The present invention relates to a grinding process for a material size reduction process based on the particle size, and more particularly, it concerns an improved grinding chamber side liner for use in a grinding section of a rotary coal pulverizer.

2. Background of the Related Art

In operations that use coal for fuel, finely-ground coal particles or "fines" are required for efficient operation, yielding higher combustion efficiency than stoker firing, as well as rapid response to load changes. Using coal fines for combustion also produces less nitrous oxide ($NO_X$) emissions and keeps oversized loss-on-ignition (LOI) unburned coal particles from contaminating the marketable ash byproduct of the combustion chamber. Thus, it is common practice to supply raw coal to a device, such as a pulverizer, that will reduce the size of the coal to particles within a desirable range prior to being used for combustion.

Many pulverizers employ systems and methods including one or more crushing and grinding stages for breaking up the raw coal. Coal particles are reduced by the repeated crushing actions of rolling or flailing elements to dust fine enough to become airborne in an air stream swept through the pulverizer. The dust particles are entrained in the air stream and carried out for combustion.

It should be readily apparent that the process of reducing solid coal to acceptably sized fines requires equipment of high strength and durability. Therefore, there exists a continuing need for grinding chamber components that, among other things, are able to withstand extremely harsh conditions so that the process can operate more efficiently with less downtime due to maintenance and repairs.

SUMMARY OF THE DISCLOSURE

The present invention improves upon and solves the problems associated with the prior art by providing, among other things, a grinding chamber side liner for protecting against coal flow damage. The grinding chamber side liner of the present invention includes a generally arcuate liner body defining a radially inner edge and a radially outer edge, among other things, wherein the radially inner edge includes an overhanging rim defining a shoulder adjacent thereto.

The grinding chamber side liner of the present invention can include a hole configured for receiving a fastening assembly to facilitate the engagement of the liner body. The liner body is preferably fabricated substantially of Ni-Hard.

In another embodiment, a grinding chamber side liner of the present invention can be constructed so that the thickness of the liner body gradually decreases from the radially outer edge to the radially inner edge. Alternatively, the thickness of the liner body can gradually decrease in one or more radially inner corners of the liner body.

The present invention is also directed to a coal pulverizer having a grinding chamber and a center shaft defining an axis of rotation and configured for rotational motion within the grinding chamber. The coal pulverizer of the present invention includes a grinding chamber side liner for attaching to the interior housing wall of the grinding chamber. This liner includes an arcuate liner body defining a radially inner edge and a radially outer edge, among other things, wherein the radially inner edge includes an overhanging rim defining a shoulder adjacent thereto.

The grinding chamber side liner of the present invention can include a hole configured for receiving a fastening assembly to facilitate the engagement of the liner body. The liner body is preferably fabricated substantially of Ni-Hard.

In another embodiment, a grinding chamber side liner of the present invention can be constructed so that the thickness of the liner body gradually decreases from the radially outer edge to the radially inner edge. Alternatively, the thickness of the liner body can gradually decrease in one or more radially inner corners of the liner body.

The present invention is also directed to a grinding chamber side liner for attaching to the interior housing wall of a grinding chamber adjacent to a cheek plate forming a gap therebetween that has a body which includes a portion for covering the gap. The body can be arcuate and define a radially inner edge and a radially outer edge, and the radially inner edge can include an overhanging rim that defines a shoulder adjacent thereto for fitting adjacent the cheek plate and covering the gap formed between the liner and cheek plate.

These and other aspects of the present invention will become more readily apparent to those having ordinary skill in the art from the following detailed description of the invention taken in conjunction with the drawings.

BRIEF DESCRIPTION OF THE FIGURES

So that those having ordinary skill in the art to which the present invention pertains will more readily understand how to make and use the present invention, an embodiment thereof will be described in detail with reference to the drawings, wherein.

DETAILED DESCRIPTION OF THE PREFERRED EMBODIMENTS

Reference is now made to the figures and accompanying detailed description which have been provided to illustrate exemplary embodiments of the present invention, but are not intended to limit the scope of embodiments of the present invention. Although a particular type of rotary coal pulverizer is shown in the figures and discussed herein, it should be readily apparent that a device or system constructed in accordance with the present invention can be employed in a variety of other coal pulverizers, or other applications that do not involve coal as the raw material. In other words, the specific material and size reduction process is not vital to gaining the benefits associated with using a system constructed in accordance with the present invention.

Figure 1:
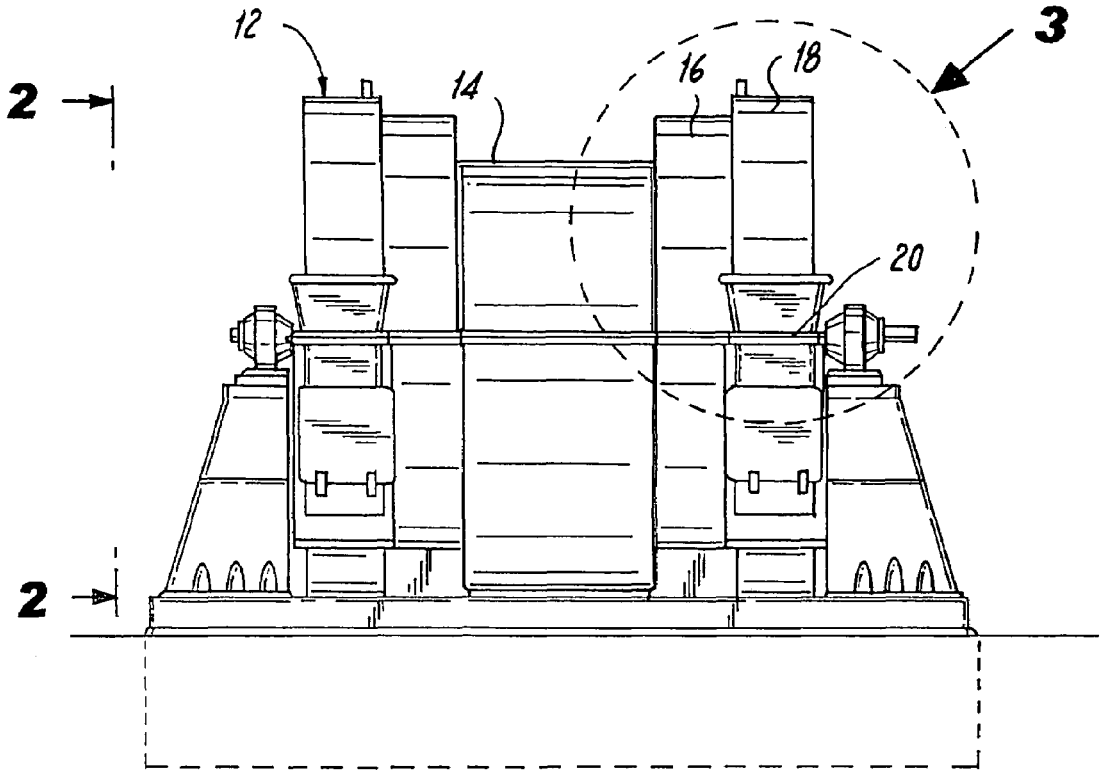
FIG. 1 is front view of an exemplary rotary coal pulverizer (duplex model) which can employ a grinding chamber side liner constructed in accordance with the present invention therein mounted on the center shaft at two locations.
Figure 2:
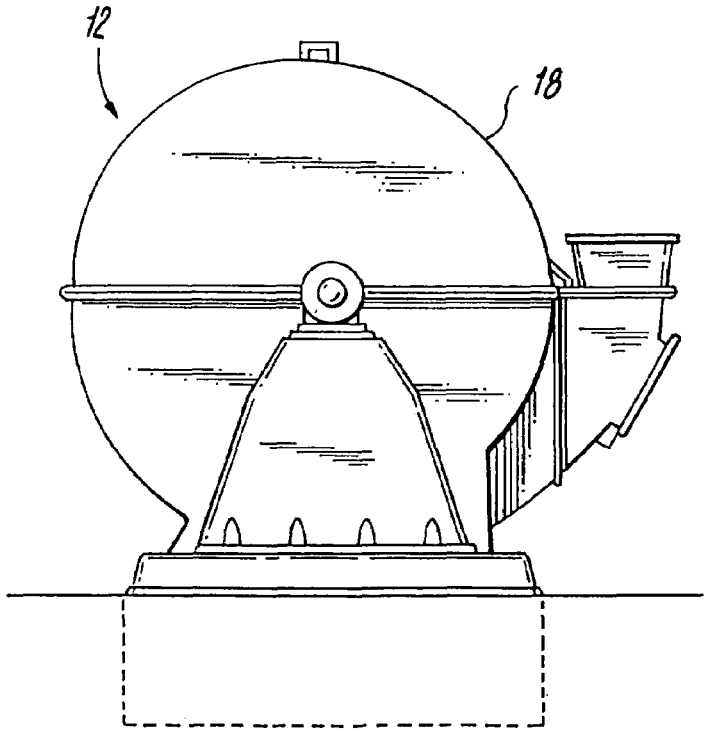
FIG. 2 is a side view of the rotary coal pulverizer of FIG. 1, illustrating the output from the fan section of the pulverizer.

FIGS. 1 and 2 illustrate the general location of a presently preferred embodiment of a grinding side chamber liner (hereinafter also referred to as a "liner") constructed in accordance with the present invention and employed in an exemplary rotary coal pulverizer 12, from the exterior of pulverizer 12. Pulverizer 12 is known as a horizontal type high speed coal mill and is closely based on a duplex model ATRITA® Pulverizer sold commercially by Babcock Power Inc. However, this should not be interpreted as limiting the present invention in any way, as many types of pulverizing devices employ similar elements and are suitable for use with the present invention.

The duplex model is essentially two single models side by side. It should be readily apparent that a clip constructed in accordance with the present invention may also be disposed in a single model. For purposes of ease and convenience in describing the features of the present invention, only a single side of the duplex model is discussed herein.

Figure 3:
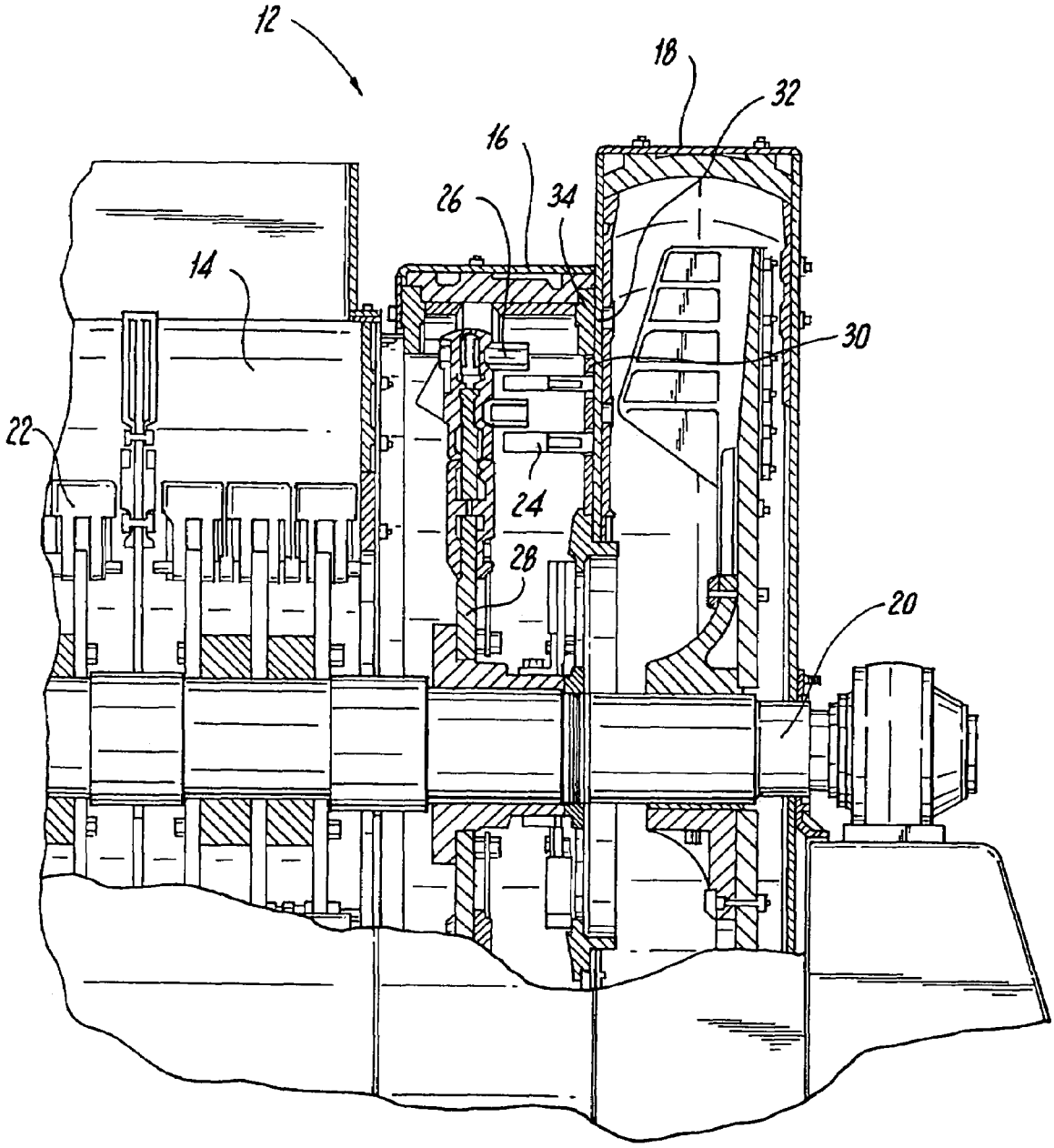
FIG. 3 (Prior Art)
FIG. 3 is an enlarged localized partial cross-sectional view of a portion of the exemplary rotary coal pulverizer of FIG. 1, illustrating a prior art grinding chamber side liner abutting the grinding chamber interior walls in the grinding section.

As can be seen in FIG. 3, pulverizer 12 consists essentially of a crusher-dryer section 14, a grinding section 16 and a fan section 18. A center shaft 20 extends through the pulverizer 12 and defines an axis of rotation. Thus, terms used herein, such as "radially outer" and "radially inner," therefore refer to the relative distance in a perpendicular direction from the axis defined by center shaft 20, while "axially inner" and "axially outer" refer to the distance along or parallel to the axis defined by center shaft 20, wherein the "axially innermost" section in pulverizer 12 is crusher-dryer section 14.

Raw coal and primary air enter the crusher-dryer section 14. Swing hammers 22 mounted on and driven by center shaft 20, along with impact liners (not shown), operate to crush the coal against a grid (not shown). High temperature primary air is used to flash dry any surface moisture on the coal, which helps minimize the effect of moisture on coal capacity, coal fineness, and power consumption, among other things. As the high-temperature primary air evaporates moisture from the coal, the temperature of the coal-air mixture is reduced, which significantly reduces the risk of fires within the pulverizer.

When coal passes through the grid of the crusher-dryer section 14, it enters the axially outer adjacent grinding section 16. The major grinding components in grinding section 16 include grinding and impeller clips 26 disposed on a rotating disc or wheel assembly 28 and stationary pegs 24 mounted on an opposing cheek plate 30 which abuts the interior grinding chamber wall 32. The staggered arrangement of clips 26 extending from wheel assembly 28, and pegs 24 extending from cheek plates 30, form an interdigitated relationship in the interior of grinding section 16.

Wheel 28 is mounted on and driven by center shaft 20, preferably at a relatively high rate of speed. In operation, the movement of clips 26 and pegs 24 cause the turbulent flow of coal particles within the grinding section 16. The turbulent flow and impact momentum on particles create a particle to particle attrition which further reduces the size of the coal particles received from crusher-dryer section 14. The turbulent flow also results in punishing coal impact within interior grinding section 16 that could eventually damage grinding chamber wall 32.

Figure 4:
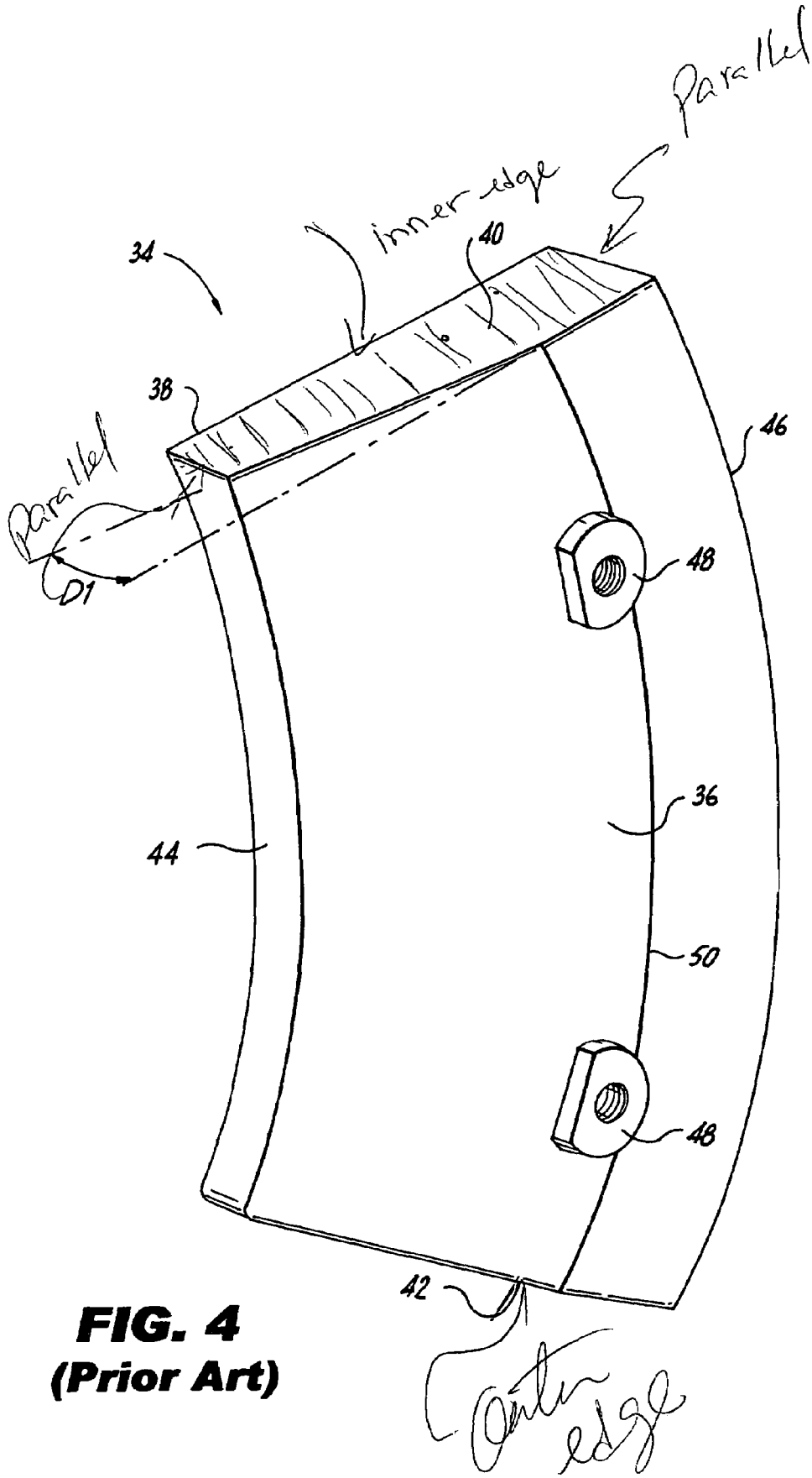
FIG. 4 (Prior Art)
FIG. 4 is a perspective view illustrating a prior art grinding chamber side liner.
Figure 5:
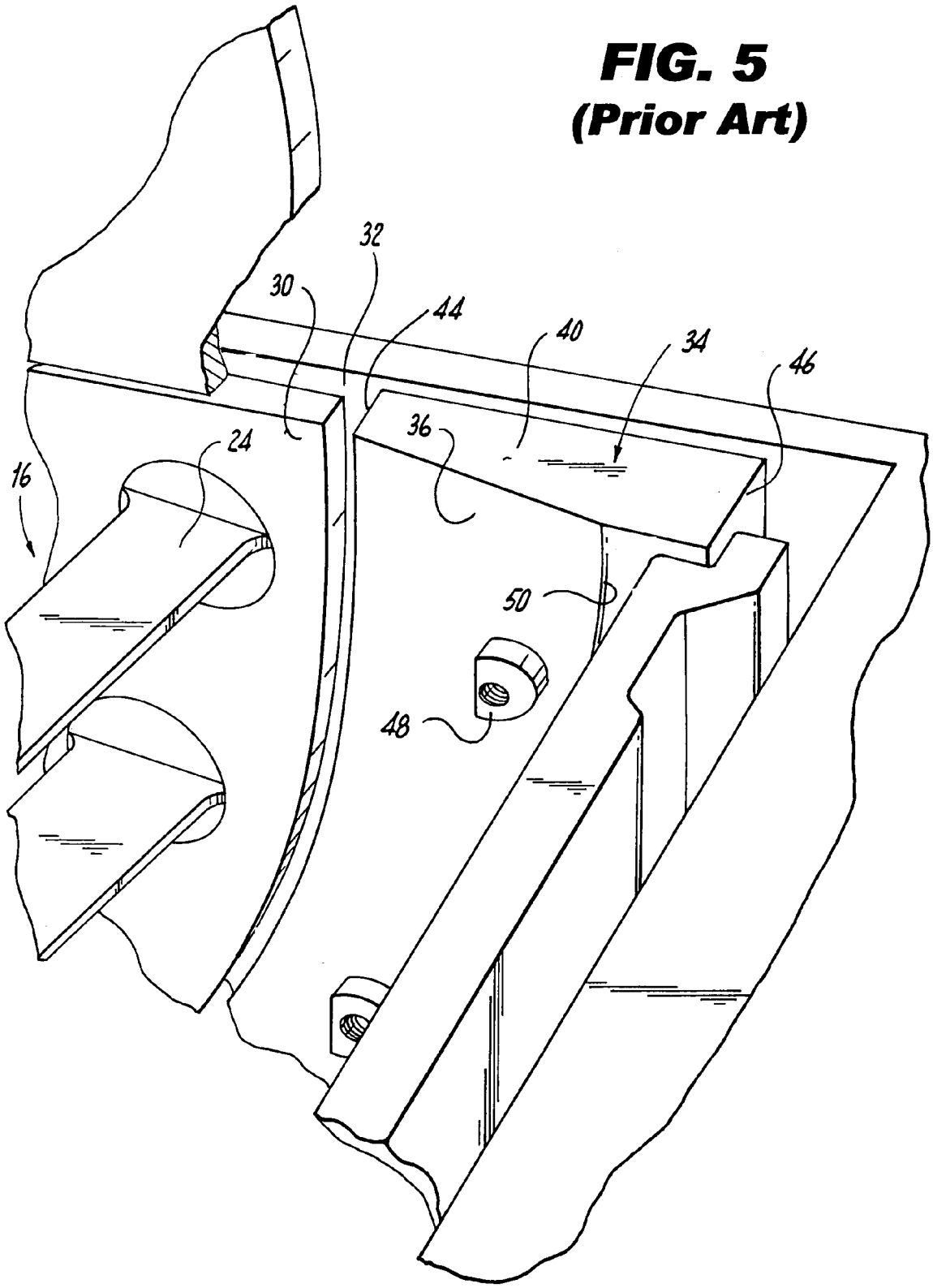
FIG. 5 (Prior Art)
FIG. 5 is a partial perspective view of a prior art grinding chamber side liner installed adjacent a cheek plate in the grinding chamber of a coal pulverizer.
Figure 6:
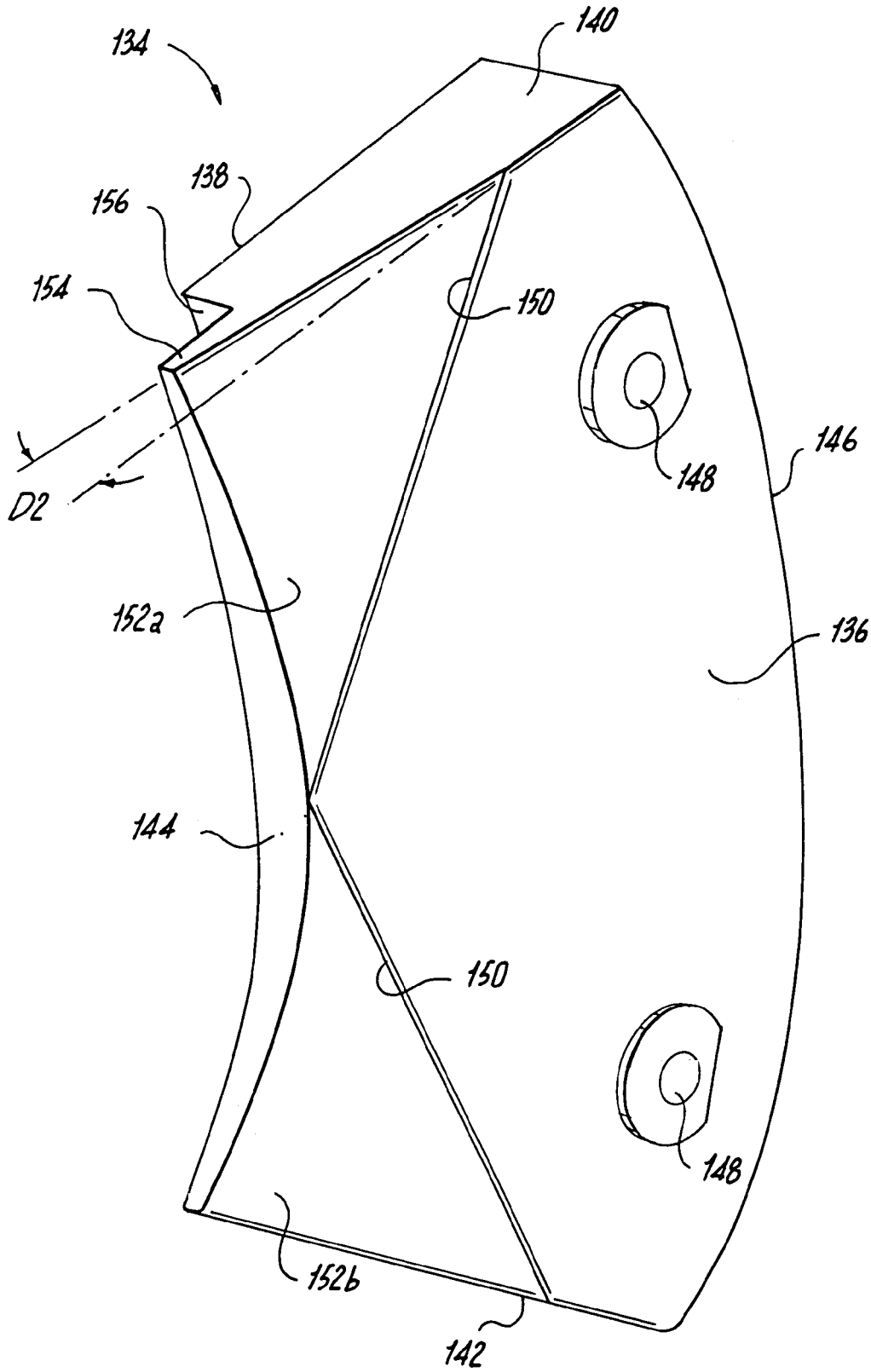
FIG. 6 is a perspective view of a grinding chamber side liner constructed in accordance with the present invention.
Figure 7:
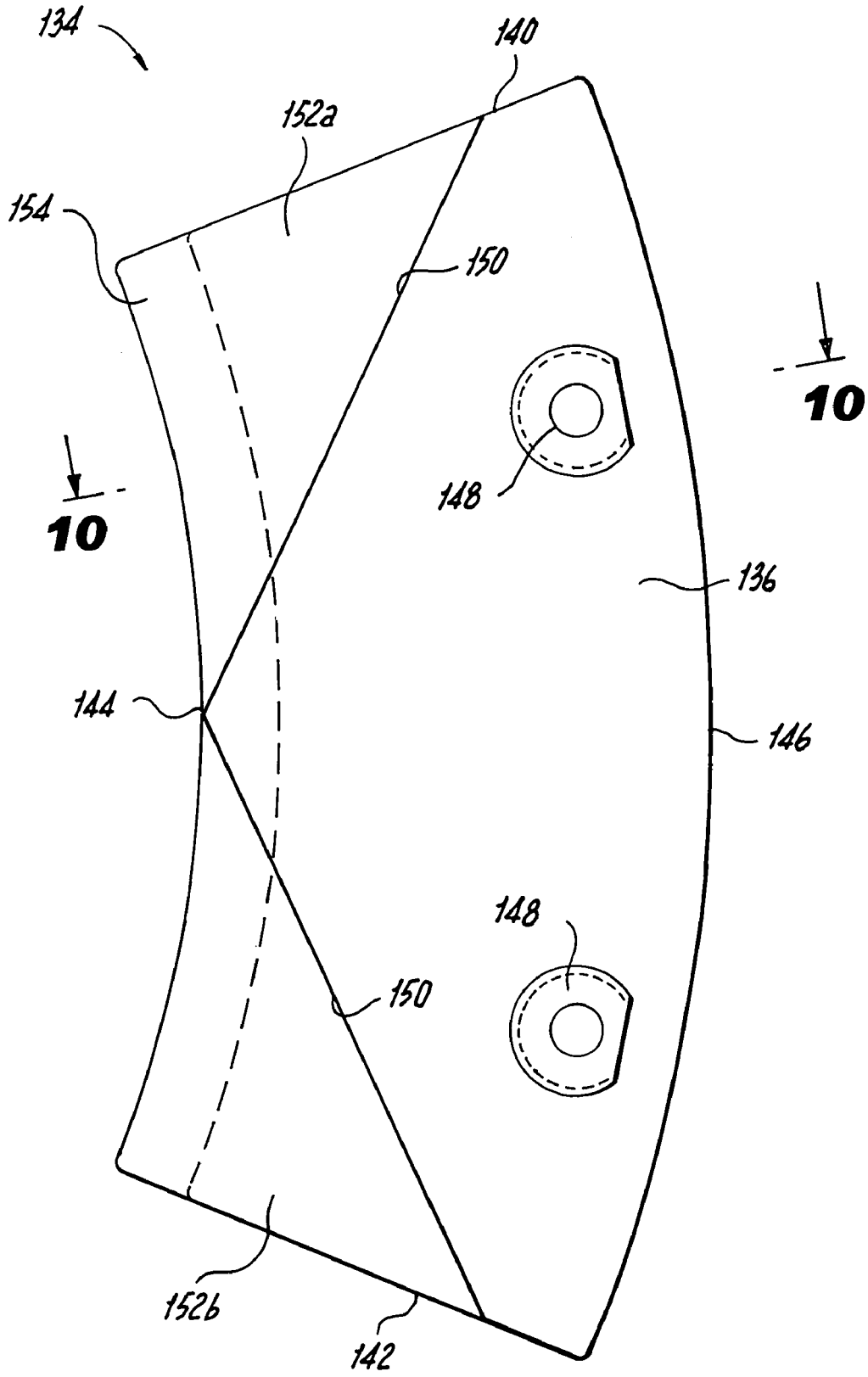
FIG. 7 is a front view of the grinding chamber side liner shown in FIG. 6 constructed in accordance with the present invention.
Figure 8:
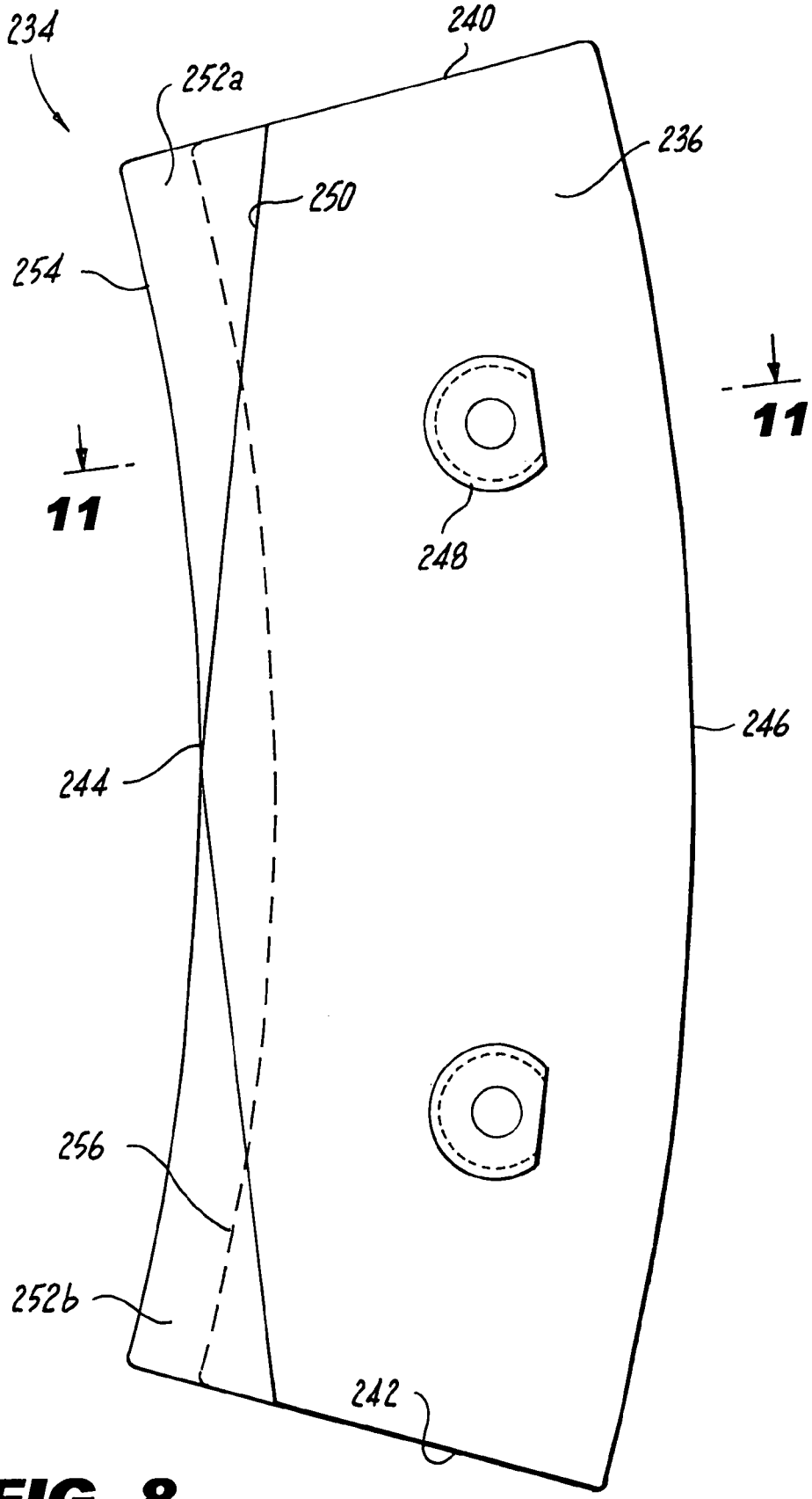
FIG. 8 is a front view of another embodiment of a grinding chamber side liner constructed in accordance with the present invention, illustrating a liner that differs in shape and cross sectional thickness as compared to the embodiment shown in FIG. 6.

Cheek plates 30 and, up to now, liners 34 were used to protect the interior grinding chamber wall 32 in prior art devices. As shown particularly in FIG. 4, a prior art liner 34 includes a front surface 36 and opposing back surface 38, upper end 40, lower end 42, inner edge 44 and outer edge 46. As shown in FIGS. 4 and 5, two threaded holes 48 in front surface 36 extend through liner 34 for fastening liner 34 in grinding section 16 such that back surface 38 abuts the interior of grinding chamber wall 32. Liner 34 is generally curved along its longitudinal axis between upper end 40 and lower end 42, to match the curvature of cheek plates 30, among other things. Outer edge 46 is longer than inner edge 44 due to the curved shape of liner 34, which permits liner 34 to be disposed in a radially outer position with respect to cheek plates 30. The thickness of liner 34 between front surface 36 and back surface 38 gradually decreases to inner edge 44. The thickness begins to decrease at a brow 50, which extends longitudinally along liner 34 between upper end 40 and lower end 42 and runs parallel to outer edge 46, as illustrated by the arrow D1.

In contrast, FIGS. 6-14 illustrate grinding chamber side liners constructed in accordance with the present invention. Liner 134 is generally curved longitudinally in the same fashion as liner 34. In this embodiment, brow 150 extends from upper end 140 and lower end 142 toward inner edge 144, converging at or about the longitudinal midpoint of inner edge 144. The configuration of brow 150 forms two opposing inner corners 152*a* and 152*b* which decrease in thickness as they extend in the direction of inner edge 144 and towards upper and lower ends 140 and 142, respectively, as illustrated by the arrow D2. The angle formed by D2 can range from about 1 to about 50 degrees, and is preferably between 5 and 15 degrees.

Figure 9:
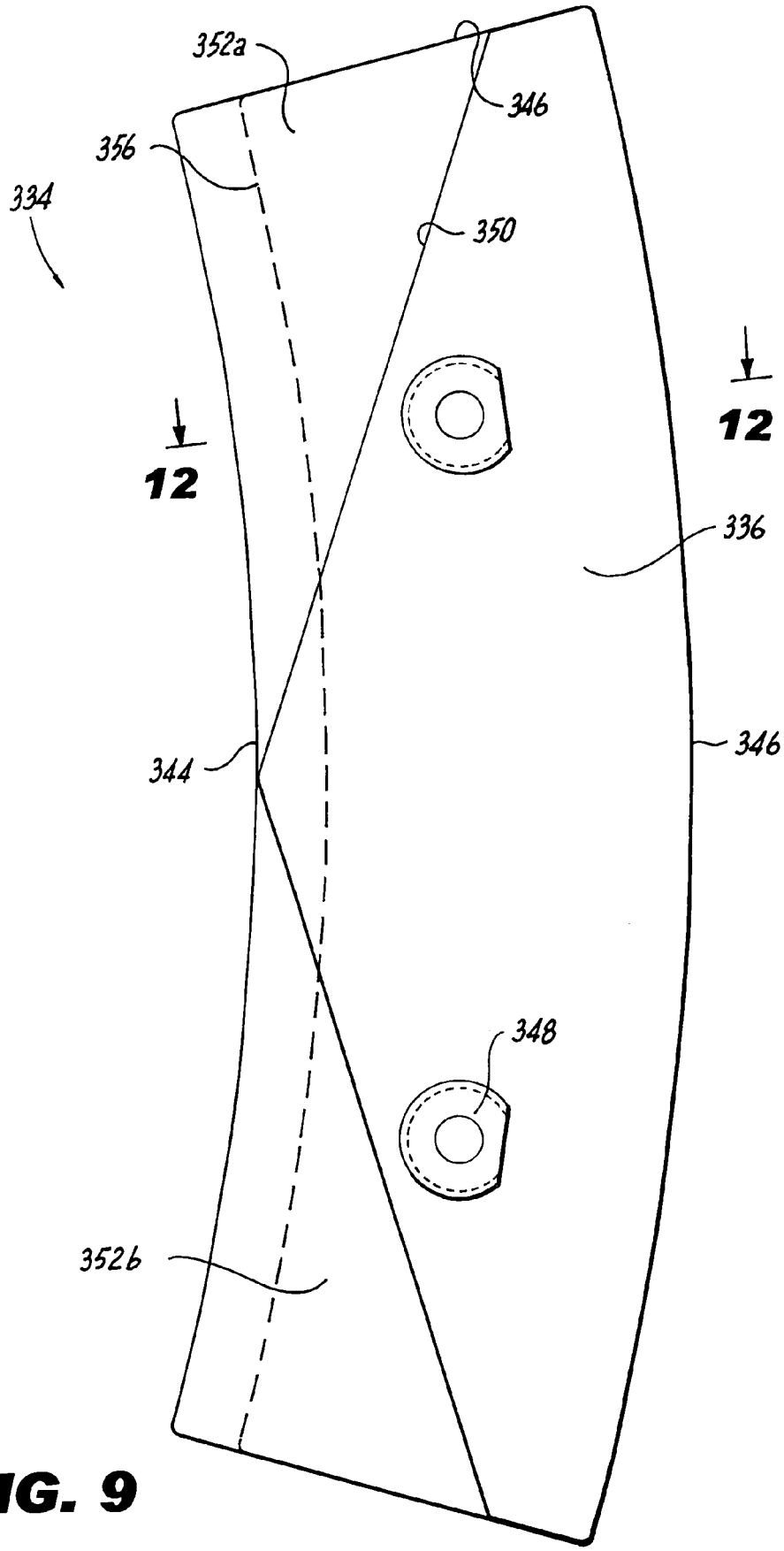
FIG. 9 is a front view of another embodiment of a grinding chamber side liner constructed in accordance with the present invention illustrating another liner that differs in shape and cross sectional thickness as compared to the embodiment shown in FIGS.6 and 8.
Figure 10:
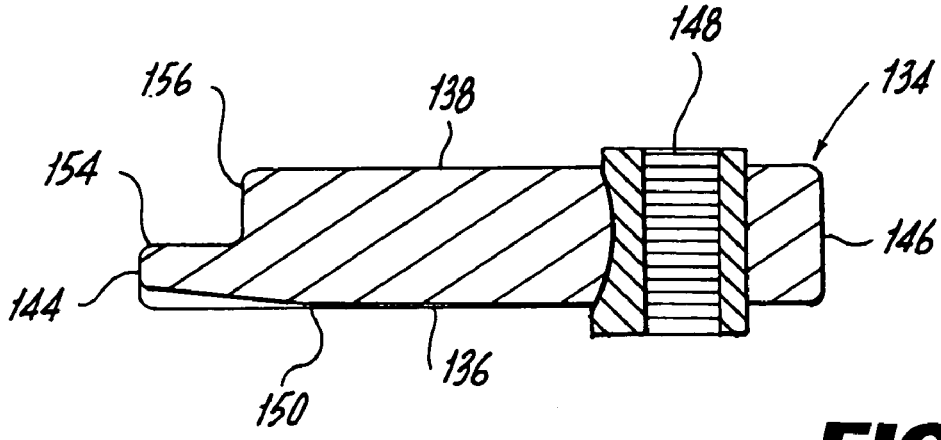
FIG. 10 is a cross sectional view of the liner shown in FIG. 6, illustrating the overhanging rim and shoulder and reduction in cross sectional thickness at the radially inner edge.
Figure 11:
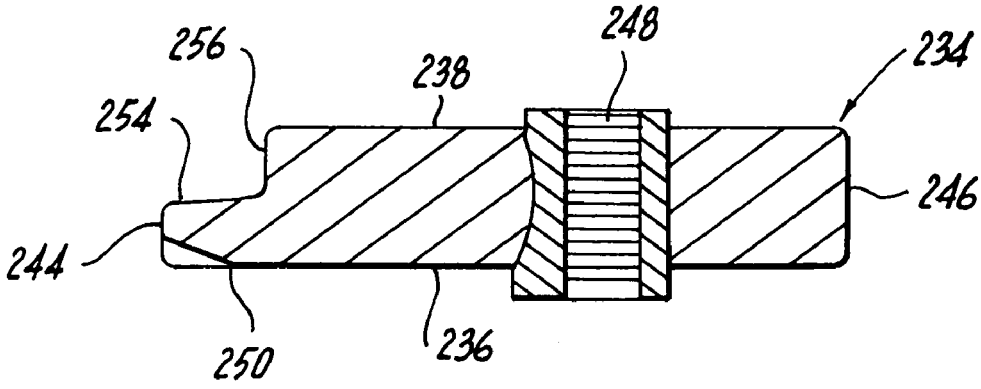
FIG. 11 is a cross sectional view of the liner shown in FIG. 8, illustrating the overhanging rim and shoulder and reduction in cross sectional thickness at the radially inner edge.
Figure 12:
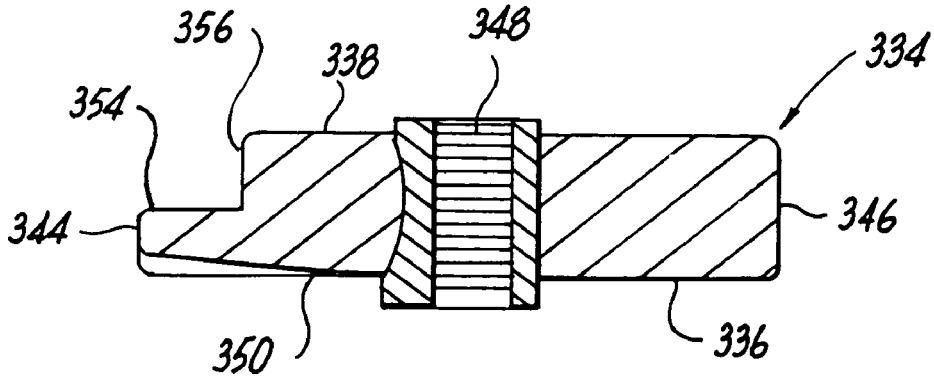
FIG. 12 is a cross sectional view of the liner shown in FIG. 9, illustrating the overhanging rim and shoulder and reduction in cross sectional thickness at the radially inner edge.
Figure 13:
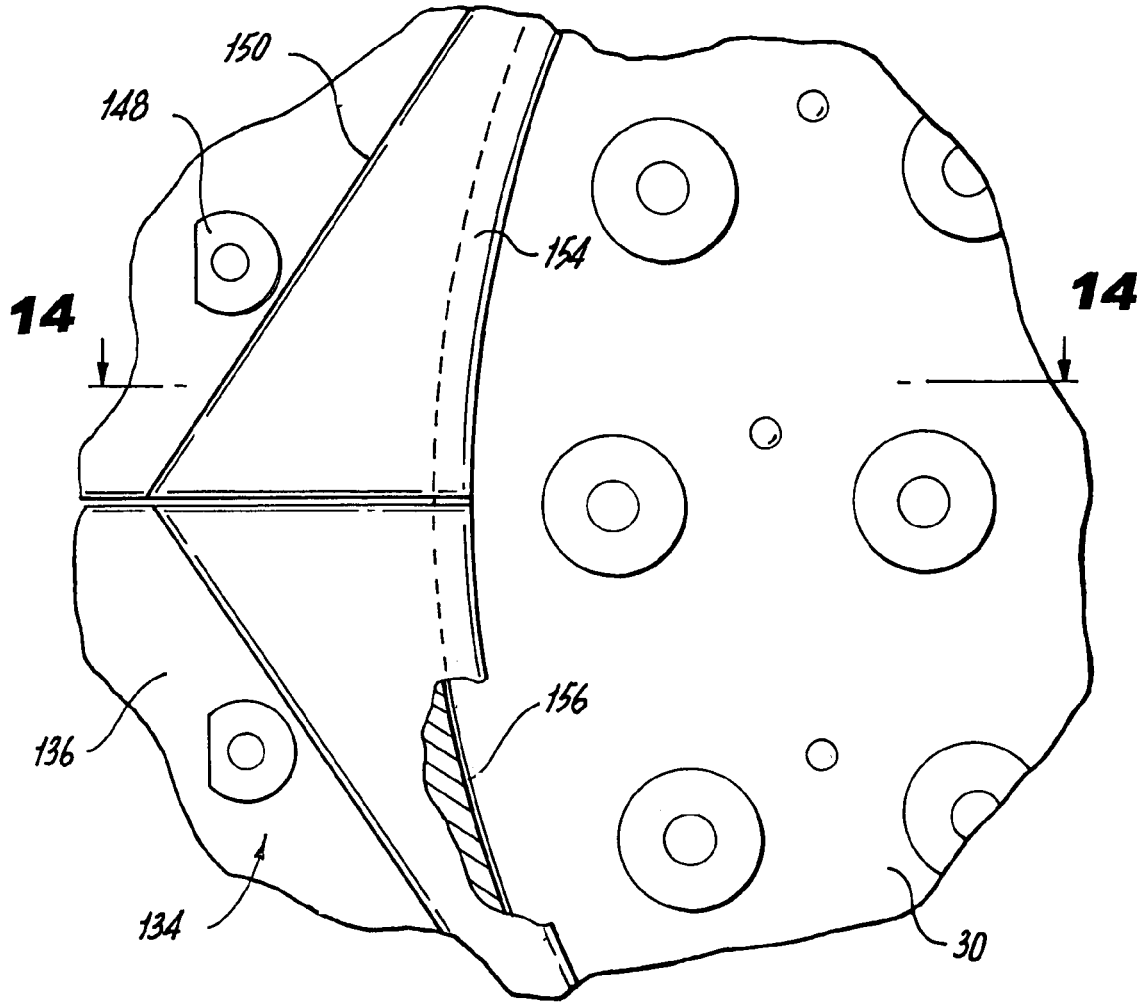
FIG. 13 is a partial front view of the liner shown in FIG. 6 installed adjacent a cheek plate in the grinding chamber of a coal pulverizer illustrating the manner in which the overhanging rim covers the gap between the liner and the cheek plate.
Figure 14:
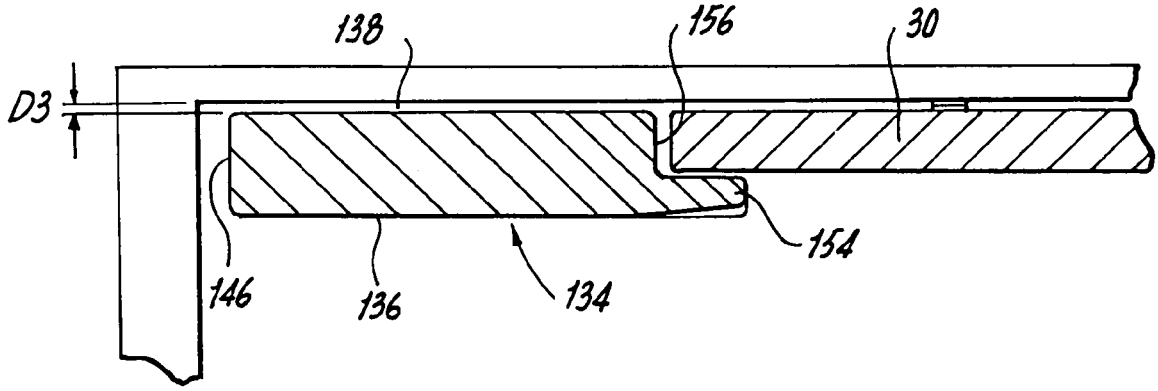
FIG. 14 is a partial cross sectional view of the liner installed in the grinding chamber as shown in FIG. 13, further illustrating the manner in which a liner constructed according to the present invention is installed in the grinding chamber of a coal pulverizer.
Figure 4:
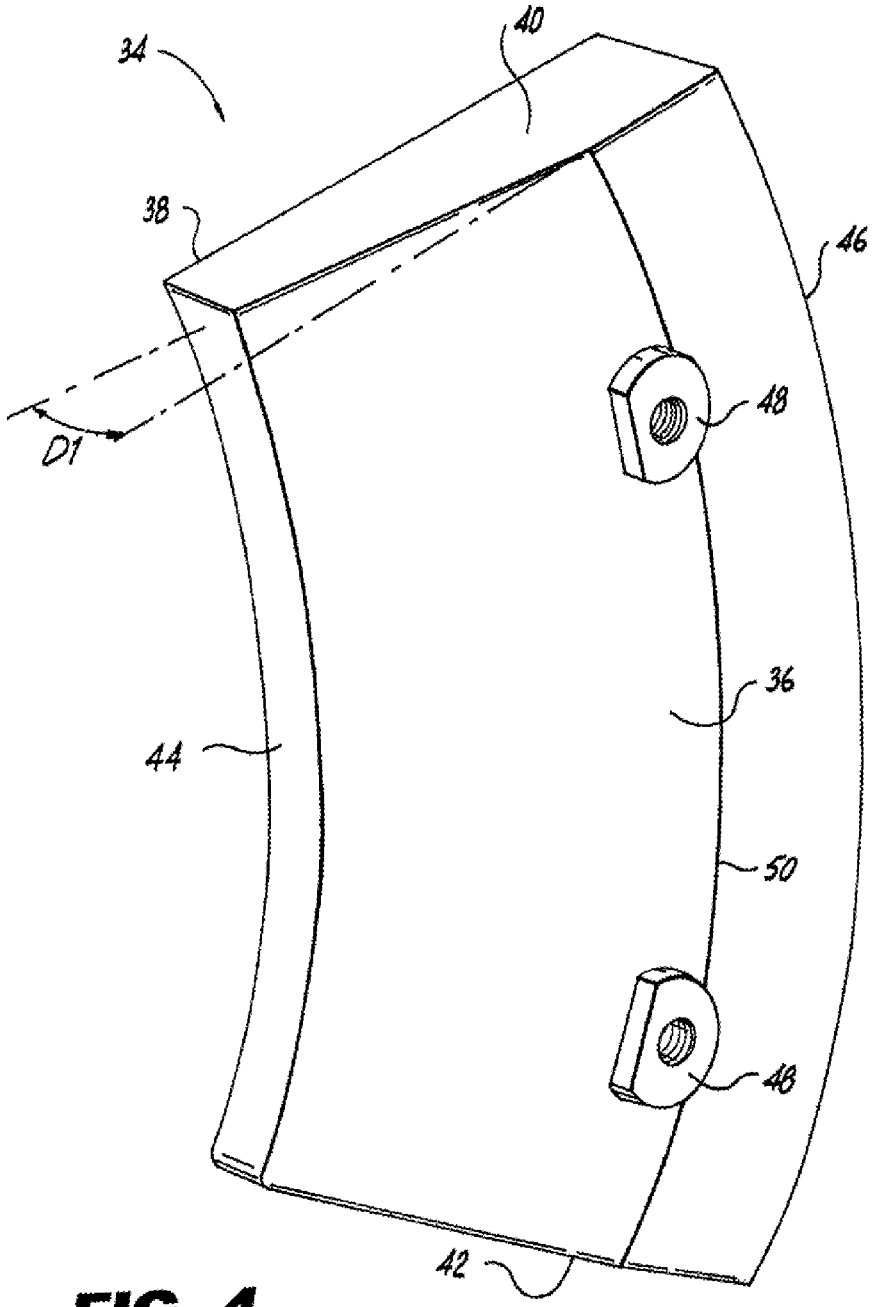
FIG. 4 (Prior Art)

Alternative configurations of side liners which include a reduction in thickness adjacent the radially inner edge are shown in FIGS. 8-9 and 11-12. Side liner 234 of FIGS. 8 and 11, includes a brow 250 that converges at or about the midpoint of inner edge 244 as in side liner 134. However, brow 250 of side liner 234 begins at a location on upper and lower ends 240 and 242 that is radially inner when compared with the placement of brow 150 on side liner 134. As shown in FIGS. 9 and 12, side liner 334 includes fastening holes 248 that are placed at a location which is radially inner when compared to the location of holes 148 in side liner 134.

One of the main problems found with prior art liner 34 is the approximately ½ inch (about 12.7 mm) gap formed between inner edge 44 of liner 34 and the outer edge of cheek plate 30 when liner 34 is installed. This gap allows coal flow therein which impacts the housing wall, in particular, the lower housing division plate, causing damage thereto. The wear and tear eventually forces the entire system to be shut down for repairs.

In this embodiment, front surface 132 of liner 134 also extends beyond inner edge 144 to form an overhanging rim or ledge 154 and shoulder 156 underneath. Shoulder 156 allows the liner 134 to fit in the same location as prior art liner 34 while overhanging ledge 154 covers the gap between the inner edge 144 of liner 134 and the outer edge of cheek plate 30. Thus, the configuration of liner 134 protects the housing wall, as shown in particular in FIGS. 13 and 14, among other things. A shim can be used between rear surface 138 and the housing wall to extend liner 134 from the wall so that overhanging ledge 154 fits properly over cheek plate 30, if necessary, as shown by the arrow D3.

Liner 134 can be constructed of any materials capable of withstanding the punishing wear and tear of being used in a pulverizer, such as pulverizer 12, such as Ni-Hard (i.e., cast iron to which nickel has been added to make it resist abrasion).

Although exemplary and preferred aspects and embodiments of the present invention have been described with a full set of features, it is to be understood that the disclosed system and method may be practiced successfully without the incorporation of each of those features. For example, many industries include applications that utilize raw materials that are first broken up into relatively small sized particles. Accordingly, the raw materials are fed into devices that employ one or more physical processes to reduce the size of the raw material prior to their use.

A grinding chamber side liner constructed according to the present invention can be utilized for such purposes. Thus, it is to be further understood that modifications and variations may be utilized without departure from the spirit and scope of this inventive system and method, as those skilled in the art will readily understand. Such modifications and variations are considered to be within the purview and scope of the appended claims and their equivalents.

What is claimed is:

1. A pulverizer comprising:

a) a grinding chamber;

b) a center shaft disposed in the grinding chamber, the center shaft defining an axis of rotation and configured for rotational motion within the grinding chamber;

c) a grinding chamber interior wall disposed substantially perpendicular to the center shaft, the interior wall including at least one cheek plate disposed thereon; and d) a grinding chamber side liner attached to the interior wall of the grinding chamber, the liner having an elongate arcuate liner body having a substantially planar back face attached against the interior wall and a front face facing the interior of the grinding chamber disposed between a radially inner edge and a radially outer edge, wherein:

i) the front face has a radial dimension that changes along a length of the liner body; and ii) the radially inner edge includes an overhanging rim defining a shoulder adjacent thereto, the rim overlapping a radially outer edge of the cheek plate to cover a gap defined between the shoulder of the liner body and the adjacent cheek plate in the grinding chamber.

2. A coal pulverizer as recited in claim 1, wherein the liner body includes a hole configured for receiving a fastening assembly to facilitate the engagement of the liner body to the interior wall of the grinding chamber.

3. A coal pulverizer as recited in claim 1, wherein the thickness of the liner body gradually decreases from the radially outer edge to the radially inner edge.

4. A coal pulverizer as recited in claim 1, wherein the thickness of the liner body gradually decreases in a radially inner corner of the liner body.

5. A coal pulverizer as recited in claim 1, wherein the liner body includes Ni-Hard.

6. A pulverizer as recited in claim 1, wherein to rim defines a arc along the length of to radially inner edge.

7. A grinding chamber side liner for attaching to the interior housing wall of a grinding chamber adjacent to a cheek plate, the liner comprising a liner body including:

a) a portion for covering a gap formed between the side liner and the cheek plate; and b) a brow having first and second segments that are angled with respect to each other and defining an apex proximate an inner edge of the liner body.

8. A grinding chamber side liner as recited in claim 7, wherein the liner body is arcuate and defines a radially inner edge and a radially outer edge.

9. A grinding chamber side liner as recited in claim 8, wherein the radially inner edge includes an overhanging rim defining a shoulder adjacent thereto for covering the gap formed between the liner and cheek plate.

10. A grinding chamber side liner as recited in claim 9, wherein the thickness of the liner body gradually decreases from the radially outer edge to the radially inner edge.

11. A grinding chamber side liner as recited in claim 8, wherein the liner body further includes a substantially planar back face adapted to be attached against the interior wall and a substantially planar front face adapted to face the interior of the grinding chamber, the front face being disposed between the radially inner edge and the radially outer edge.

12. A grinding chamber side liner as recited in claim 11, wherein the brow is defined on the front face of the liner body.

13. A grinding chamber side liner as recited in claim 12, wherein the thickness of the liner body gradually decreases from the brow of the liner body to the radially inner edge of the liner body.

14. A grinding chamber side liner as recited in claim 7, wherein the liner body is metallic.

15. A grinding chamber side liner as recited in claim 14, wherein the liner body includes Ni-Hard.

16. A grinding chamber side liner for protecting against abrasion damage comprising:

a) an arcuate liner body having a width and a thickness, the liner body having:

i) a radially outer edge, and ii) a radially inner edge, wherein the width of the liner body is defined between the radially outer and inner edges, the radially inner edge having a surface defined between a first end, a second end and two substantially parallel edges connecting the first end and the second end and being separated by the thickness of the liner body, wherein the thickness changes along a length of the liner body between the first end and the second end and wherein the width of the liner body is substantially larger than the thickness of the liner body.

17. The grinding chamber side liner of claim 16, wherein the radially inner edge further defines an overhanging rim defining a shoulder adjacent thereto for being mounted adjacent to protective plates, wherein the overhanging rim is adapted to cover a gap formed between the liner body and an adjacent plate installed in the grinding chamber.

18. A grinding chamber side liner as recited in claim 16, wherein each of the two substantially parallel edges defines an arc along a length of to arcuate liner body.

19. A system for protecting against abrasion damage comprising:

a) a rigid arcuate liner body mounted within a grinding chamber, the liner body defining a radially inner edge and a radially outer edge, wherein the radially inner edge includes an overhanging rim defining a shoulder adjacent thereto, wherein the overhanging rim defines an arc along the length of the radially inner edge b) a cheek plate located radially inwardly from and adjacent to the body in the grinding chamber, wherein the overhanging rim of the liner body covers a gap formed between the liner body and the cheek plate with the overhanging rim overlapping a portion of the cheek plate; and c) a shim for mounting between the liner body and a mounting surface in the grinding chamber to provide adequate clearance between the liner body and the adjacent overlapping cheek; and d) a cheek plate located radially inwardly from and adjacent to the liner body.

* * * * *

UNITED STATES PATENT AND TRADEMARK OFFICE

CERTIFICATE OF CORRECTION

PATENT NO. : 7,306,178 B2
APPLICATION NO. : 11/070525
DATED : December 11, 2007
INVENTOR(S) : William Schmitz It is certified that error appears in the above-identified patent and that said Letters Patent is hereby corrected as shown below:

In the Drawings:
Delete FIG. 4 (Sheet 3 of 10) and replace with FIG. 4. (ATTACHED)

Signed and Sealed this

Fourth Day of November, 2008

JON W. DUDAS
*Director of the United States Patent and Trademark Office*